United States Patent [19]

Urban

[11] Patent Number: 4,481,107

[45] Date of Patent: Nov. 6, 1984

[54] OXIDATION OF DIFFICULTLY OXIDIZABLE MERCAPTANS

[75] Inventor: Peter Urban, Northbrook, Ill.

[73] Assignee: UOP Inc., Des Plaines, Ill.

[21] Appl. No.: 597,310

[22] Filed: Apr. 6, 1984

[51] Int. Cl.[3] ..... C10G 19/00; C10G 19/02; C10G 29/00

[52] U.S. Cl. ..... 208/206; 208/207

[58] Field of Search ..... 208/206, 207

[56] References Cited

U.S. PATENT DOCUMENTS

| | | | |
|---|---|---|---|
| 2,464,019 | 3/1949 | Bond et al. | 208/204 |
| 2,488,000 | 11/1949 | Bernard | 208/205 |
| 2,535,833 | 12/1950 | Bond | 208/205 |
| 2,556,837 | 6/1951 | Browder | 208/206 |
| 3,108,081 | 10/1963 | Gleim et al. | 252/428 |
| 3,260,665 | 7/1966 | Urban | 208/206 |
| 3,371,031 | 2/1968 | Strong | 208/207 |
| 3,408,287 | 10/1968 | Urban et al. | 208/206 |
| 3,409,543 | 11/1968 | Urban et al. | 208/206 |

FOREIGN PATENT DOCUMENTS

| | | | |
|---|---|---|---|
| 1507644 | 11/1954 | Canada | 208/206 |

*Primary Examiner*—Delbert E. Gantz
*Assistant Examiner*—Helane E. Maull
*Attorney, Agent, or Firm*—William H. Page, II; John G. Cutts, Jr.

[57] ABSTRACT

A process is disclosed for oxidizing difficultly oxidizable mercaptans contained in a hydrocarbon fraction which comprises adding a hydrocarbon soluble alkali metal compound, capable of forming the alkali metal mercaptides of the difficultly oxidized mercaptans, to the hydrocarbon fraction; and contacting the resulting hydrocarbon fraction containing the hydrocarbon soluble alkali metal compound with a metal chelate catalyst disposed on an adsorptive support in the presence of a hydrated oxygen-containing gas and in the absence of a separate water phase.

18 Claims, No Drawings

OXIDATION OF DIFFICULTLY OXIDIZABLE MERCAPTANS

BACKGROUND OF THE INVENTION

FIELD OF THE INVENTION

The present invention relates to a novel method for the oxidation of difficultly oxidizable mercaptans contained in a hydrocarbon fraction. Processes for the treatment of sour petroleum distillates wherein the distillate is treated in contact with an oxidation catalyst in the presence of an oxidizing agent at alkaline reaction conditions have become well known and widely practiced in the petroleum refining industry. Said processes are typically designed to effect the oxidation of offensive mercaptans contained in a sour petroleum distillate with the formation of innocuous disulfides—a process commonly referred to as sweetening. The oxidizing agent is most often air. Gasoline, including natural, straight run and cracked gasolines, is the most frequently treated sour petroleum distillate. Other sour petroleum distillates include the normally gaseous petroleum fractions as well as naphtha, kerosene, jet fuel, fuel oil, lube oil, and the like.

Information Disclosure

A commonly used continuous process for treating sour petroleum distillates entails treating the distillate in contact with a metal phthalocyanine catalyst dispersed in an aqueous caustic solution to yield a doctor sweet product. The sour distillate and the catalyst-containing aqueous caustic solution provide a liquid-liquid system wherein mercaptans are converted to disulfides at the interface of the immiscible solutions in the presence of an oxidizing agent—usually air.

Sour petroleum distillates containing more difficulty oxidizable mercaptans are more effectively treated in contact with a metal chelate catalyst disposed on a high surface are a absorptive support—usually a metal phthalocyanine on an activated charcoal. The distillate is treated in contact with the supported metal chelate catalyst at oxidation conditions in the presence of an alkaline agent. The oxidizing agent is most often air admixed with distillate to be treated, and the alkaline agent is most often an aqueous caustic solution charged continuously to the process or intermittently as required to maintain the catalyst in a caustic wetted state. Further details of such a process are disclosed in U.S. Pat. No. 3,108,081 (Gleim).

As mentioned, the prior art is replete with various processes designed to oxidize mercaptans in hydrocarbon fractions. In U.S. Pat. No. 2,464,019 (Boud et al), for instance, a method is disclosed for oxidizing sulfur compounds occurring in petroleum hydrocarbons which comprises contacting the compounds with an oxygen-containing gas in the presence of an alkaline polyhydroxy alcohol solution containing a phenolic material capable of forming a quinone upon oxidation, the solution containing less than 25 wt. % water.

U.S. Pat. No. 2,488,000 (Bernard) discloses a process for sweetening hydrocarbon liquids wherein the liquids are contacted with air in the presence of alcoholic solutions of alkali metal alcoholates containing catalytic materials. Patentee further teaches the presence of relatively small percentages of water in the solution in order to reduce the solubility of the alcohol in the hydrocarbon thereby facilitating separation of the treating solution from the desulfurized hydrocarbon. Patentee cautions that substantial quantities of water in the solution reduce the rate of desulfurization reaction.

U.S. Pat. No. 2,535,833 (Bond) similarly teaches a hydrocarbon sweetening process that involves contacting the hydrocarbon in the presence of an alcoholic alkali solution containing an oxidation catalyst. Where methyl alcohol is used it may be used in substantially anhydrous form, whereas when ethyl alcohol is used, water is preferably present in an amount of not less than 5% to prevent solution of alcohol into the hydrocarbon liquid.

U.S. Pat. No. 3,371,031 (Strong) likewise relates to a process for the oxidation of mercaptan compounds contained in a sour hydrocarbon distillate. Specifically the distillate, an alkali-alcohol solution and oxidizing agent are contained in a conversion zone with a phthalocyanine catalyst at oxidizing conditions, wherein the effluent from said conversion zone is separated into a treated hydrocarbon distillate phase and a substantially mercapto compound-free, alkali-alcohol phase, wherein at least a portion of said alkali-alcohol phase is recycled to said conversion zone, and wherein said alkali-alcohol solution accumulates surface-active materials, originally present in said hydrocarbon distillate, having a deleterious effect on the phthalocyanine catalyst.

Finally, U.S. Pat. No. 3,260,655 (Urban) teaches a process for the oxidation of difficultly oxidizable mercaptans and toxins contained in a hydrocarbon fraction. In particular, there is disclosed a combination process which includes the step of prewashing the hydrocarbon fraction with an aqueous solution containing from about 5% to about 50% by weight of an alkali metal hydroxide and from about 5% to about 40% by weight of alcohol to remove at least a portion of toxins from the fraction. The difficultly oxidizable mercaptans contained in the fraction are substantially insoluble in the solution. The resultant solution containing toxins is separated from the hydrocarbon fraction which fraction contains a portion of the alcohol. The separated alcohol-containing hydrocarbon fraction of reduced toxin content is then subjected to an oxidation step in contact with a phthalocyanine catalyst in the presence of an alcohol and alkaline phase. The resultant oxidized fraction is then postwashed with a portion of the solution containing toxins to recover a portion of the alcohol content of the oxidized fraction. The present invention does not require an alkaline phase or an alcohol in the second stage oxidation step.

SUMMARY OF THE INVENTION

The invention is, in one embodiment, a process for oxidizing difficultly oxidizable mercaptans contained in a hydrocarbon fraction which comprises: (a) adding a hydrocarbon soluble alkali metal compound, capable of forming the alkali metal mercaptides of the difficultly oxidized mercaptans, to the hydrocarbon fraction; and (b) contacting the resulting hydrocarbon fraction containing the hydrocarbon soluble alkali metal compound with a metal chelate catalyst disposed on an adsorptive support in the presence of a hydrated oxygen-containing gas and in the absence of a separate water phase.

A second embodiment of the present invention is a combination process for oxidizing difficultly oxidizable mercaptans contained in a hydrocarbon fraction in admixture with non-difficultly oxidizable mercaptans which comprises the conversion of the non-difficultly oxidized mercaptans, the oxidation of the difficultly oxidizable mercaptans by the addition of a hydrocarbon soluble alkali metal compound, capable of forming the alkali metal mercaptides of the difficultly oxidized mercaptans and the contact of the hydrocarbon fraction containing the alkali metal mercaptides with a metal chelate catalyst disposed on an adsorptive support in the presence of a hydrated oxygen-containing gas and in the absence of a separate water phase.

Other embodiments of the present invention encompass further details such as preferred mercaptan oxidation catalysts, reagents and operating conditions, all of which are hereinafter disclosed in the following discussion of each of these facets of the invention.

DETAILED DESCRIPTION OF THE INVENTION

Various metal chelates are known to the treating art as being effective to catalyze the oxidation of mercaptans. Said metal chelates include the metal compounds of tetrapyridinoporphyrazine described in U.S. Pat. No. 3,980,582, e.g., cobalt tetrapyridinoporphyrazine, porphyrin and metaloporphyrin catalysts as described in U.S. Pat. No. 2,966,453, e.g., cobalt tetraphenylporphrin sulfonate; corrinoid catalysts as described in U.S. Pat. No. 3,252,892, e.g., cobalt corrin sulfonate; chelate organometallic catalysts such as described in U.S. Pat. No. 2,918,426, e.g., the condensation product of an aminophenol and a metal of Group VIII; and the like. Metal phthalocyanines are a preferred class of metal chelates. This process, however, suffers certain disadvantages when utilized for the oxidation of mercaptan fractions containing difficultly oxidizable mercaptans.

The presence of these difficultly oxidizable mercaptans often does not allow the application of the most economic process because a doctor sweet product cannot be produced. The term sweetening is used herein in the meaning accepted in the industry to describe the oxidation of a mercaptan-containing fraction to produce a treated product containing a reduced concentration of mercaptans. If an otherwise economic process capable of oxidizing easily oxidized mercaptans is operated at severe conditions, e.g., long residence times, high temperatures, excess oxidizing agents, to produce a doctor sweet product from a hydrocarbon containing these difficult to oxidize mercaptans, then severe color degradation occurs, lowering the value of the product. The easily oxidized mercaptans are generally primary and secondary mercaptans and the oxidation resistant mercaptans are generally high molecular weight sterically hindered tertiary mercaptans.

The metal phthalocyanine catalyst is, however, very effective for the sweetening of light hydrocarbon distillates, the light hydrocarbon distillates including sour normally gaseous hydrocarbon fractions, sour gasoline, sour naphtha, etc., these hydrocarbon fractions generally not containing difficultly oxidizable mercaptans. Accordingly, there generally is no need for the more complicated process of the present invention. However, when the hydrocarbon fraction contains difficultly oxidizable mercaptans, the novel process of the present invention offers the advantage of improved sweetening of the sour hydrocarbon fraction. The process of the present invention is particularly applicable for the sweetening of a concentrated mercaptan fraction containing difficultly oxidizable mercaptans. The difficultly oxidizable mercaptans are generally contained in heavy hydrocarbons. By heavy hydrocarbons, it is meant hydrocarbons having a higher boiling point than gasoline, and includes particularly kerosene, jet fuel, diesel fuel, solvent oil, stove oil, range oil, burner oil, gas oil, fuel oil, etc. In general, a kerosene will have an initial boiling point of from about 300° to about 450° F. and an end point of greater than about 525° F. Solvent oil and stove oil, for example, usually have an initial boiling point within the range of from about 350° to about 500° F. and an end boiling point of from about 525° to about 600° F. The higher boiling fractions normally contain a greater variety of components than are contained in lower boiling fractions.

In any event, the first stage of one embodiment of the present invention involves treating the difficultly and non-difficultly oxidizable mercaptan-containing hydrocarbon fraction to convert easily or non-difficultly oxidized mercaptans to disulfides. A preferred first stage comprises the conversion of the non-difficultly oxidized mercaptan by means of contacting the hydrocarbon fraction containing the non-difficultly oxidized mercaptans with a cobalt phthalocyanine catalyst supported on an activated carbon support wetted by an aqueous alkaline solution. One of the purposes of the first stage is to reduce the reagent requirements of the second stage. The success of the second stage depends on the formation of the alkali metal mercaptides which are the chemical species that are oxidized by the second stage catalyst system. Any acidic substance, e.g., carboxylic acid, primary or secondary mercaptan or phenol will complete for the alkaline reagent of the second stage and therefore increases the amount of alkaline reagent required to obtain the alkali metal mercaptide. Water present as a separate phase in the second stage will cause the mercapto alkali salt to hydrolyze to the free mercaptan and thereby negate the desired result. Since the oxidizable species are the alkali metal mercaptides, a necessary element of the present invention is the formation of the alkali metal mercaptide by the addition of alkali metal containing organic compounds that will exchange the alkali metal with the acid hydrogen of the mercaptan. It has been discovered that such compounds must be hydrocarbon soluble. The preferred hydrocarbon soluble alkali metal containing compounds are the alkali metal alkoxides of alcohols in the $C_3$ to $C_8$ range or the alkali metal alkyl amides. The alkoxide compounds may be synthesized by the addition of the metal to the dry alcohol.

In the event that a hydrocarbon fraction has been previously treated by a sweetening process to remove or convert the non-difficultly oxidized mercaptans while leaving the difficultly oxidized mercaptans present and unconverted, such a hydrocarbon fraction may then be treated, according to another embodiment of the present invention, by directly subjecting the hydrocarbon fraction to the process which is herein referred to and described as the second stage.

In accordance with the present invention, a metal phthalocyanine catalyst may be selected for use as a mercaptan oxidation catalyst in either or both of the first and second stage. Particularly preferred metal phthalocyanines include cobalt phthalocyanine and vanadium phthalocyanine. Other metal phthalocyanines include iron phthalocyanine, copper phthalocyanine, chromium phthalocyanine, etc. The metal phthalocyanine, in general, is not readily soluble in aqueous solvent, and therefore, when used in an aqueous alkaline solution or for ease of compositing with a solid carrier, a derivative of the phthalocyanine is preferred. A particularly preferred derivative is the sulfonated derivative. Thus, an especially preferred phthalocyanine catalyst is cobalt phthalocyanine sulfonate. Such a catalyst comprises cobalt phthalocyanine disulfonate and also contains cobalt phthalocyanine monosulfonate. Another preferred catalyst comprises vanadium phthalocyanine monosulfonate. These compounds may be obtained from any source or prepared in any suitable manner as, for example, by reacting cobalt or vanadium phthalocyanine with 25-50% fuming sulfuric acid. While the sulfonic acid derivatives are preferred, it is understood that other suitable derivatives may be employed. Other derivatives include particularly the carboxylated derivative which may be prepared, for example, by the action of trichloroacetic acid on the metal phthalocyanine or by the action of phosgene and aluminum chloride. In the latter reaction the acid chloride is formed and may be converted to the desired carboxylated derivative by conventional hydrolysis.

The phthalocyanine catalyst may be utilized in the first stage either as a solution or suspension in a suitable alkaline medium or as a fixed bed in a reaction zone wherein the phthalocyanine is supported on activated carbon. The sour distillate and the catalyst-containing aqueous caustic solution provide a liquid-liquid system wherein the mercaptans are converted to disulfides at the interface of the immiscible solutions in the presence of an oxidizing agent—usually air.

Any of the hydroxides of the metals of Group IA of the Periodic Chart—the alkali metal hydroxides—can be used as a component of the first stage of the invention. The alkali metal hydroxide component of this invention can be a single alkali metal hydroxide, or a mixture of two or more alkali metal hydroxides. Potassium hydroxide is also preferred. The alkali metal hydroxides are widely available commercially. They may be made by the electrolysis of aqueous alkali-salt solutions, usually the chloride salt, or by the hydration of alkali metal hydrides. A preferred alkaline solution for the oxidation or sweetening is an aqueous solution of from about 1% to about 50% and more particularly from about 5% to about 25% by weight concentration of sodium hydroxide or potassium hydroxide. As hereinbefore set forth, the oxidation or sweetening advantageously is effected in the presence of alcohol and particularly methanol. When desired, all or a portion of the alcohol may be introduced into the alkaline solution or suspension prior to introduction into the reaction zone. In general, the amount of alcohol present in the reaction zone will comprise from about 5% and preferably from about 15% to about 30% by weight of the alkaline reagent solution. Aqueous ammonia may also be used as an alkaline reagent solution.

In a preferred embodiment of the first stage, where the phthalocyanine catalyst is supported on a high surface area adsorptive support situated in a fixed bed, the hydrocarbon is preferably contacted with the supported catalyst at oxidation conditions in the presence of an aqueous alkaline agent. The oxidizing agent is often air admixed with the distillate to be treated, and the alkaline agent is most often an aqueous caustic solution charged continuously to the process or intermittently as required to maintain the catalyst in a caustic wetted state. The first stage optimizes the removal of acidic compounds as the high surface area adsorptive support acts in conjunction with the alkaline reagent to solubilize acid materials. Any suitable support may be employed and preferably comprises activated charcoal, coke or other suitable forms of carbon. In some cases the support may comprise silica, alumina, magnesia, etc. or mixtures thereof. The solid catalyst is prepared in any suitable manner. In one method, preformed particles of the solid support are soaked in a solution containing the phthalocyanine catalyst, after which excess solution is drained off and the catalyst is used as such or is subjected to a drying treatment, mild heating, blowing with air, hydrogen, nitrogen, etc., or successive treatments using two or more of these treatments prior to use. In other methods of preparing the solid composite, a solution of the phthalocyanine catalyst may be sprayed or poured over the particles of the solid support, or such particles may be dipped, suspended, immersed or otherwise contacted with the catalyst solution. The concentration of phthalocyanine catalyst in the composite may range from 0.01% to 10% by weight or more of the composite. When the catalyst is used as a fixed bed, in one embodiment it may be pretreated with an alkaline solution which may or may not contain alcohol. In another embodiment an alkaline solution which may or may not contain alcohol is continuously or intermittently introduced into the oxidation or sweetening zone during processing.

The effluent from the first stage reaction zone is coalesced to remove suspended water and is then passed to a separator to recover the caustic phase prior to passing the hydrocarbon phase to the second stage reaction zone for further treatment. The second stage of the present invention combination process involves passing the hydrocarbon reduced in mercaptan content into a dry bed of metal chelate supported on an activated carbon. The disulfides need not be removed prior to passing the effluent from the first stage to the second stage.

The second stage essentially involves the addition of a hydrocarbon soluble alkali metal compound, which is capable of forming the alkali metal mercaptides of the difficultly oxidized mercaptans, to the hydrocarbon fraction containing difficultly oxidizable mercaptans and then contacting the resulting hydrocarbon fraction with a metal chelate disposed on an adsorptive support in the presence of a hydrated oxygen-containing gas and in the absence of a separate water phase. Preferred hydrocarbon soluble alkali metal compounds include alkali metal alkoxide and alkali metal amide. The hydrocarbon soluble alkali metal compounds are preferably present in an amount from about 0.5 to about 5 molar ratio or alkali metal compound to mercaptans. Those hydrocarbon soluble alkali metal compounds which are capable of forming the alkali metal mercaptides of the difficultly oxidized mercaptans also display the ability to be essentially hydrolyzed to hydroxide and the hydrogen form of the compound by water. The alkali metal alkoxide is preferably derived from a $C_3$ to $C_8$ monohydric alcohol. Sodium isopropoxide is a preferred alkali metal alkoxide.

Another essential feature of the second stage, as hereinabove mentioned, is the addition of a hydrated oxygen-containing gas. The amount of water required is generally an amount ranging up to the amount that saturates an oxygen-containing gas such as air at the temperature employed. Excess water, above the amount soluble in the hydrocarbon fraction is undesirable, and therefore, the absence of a separate water phase in the second stage is essential. The second stage may also be operated at superatmospheric pressure in order to dissolve the hydrated oxygen-containing gas in the hydrocarbon phase.

U.S. Pat. No. 2,464,019 differs from the second stage of one embodiment of the present process in several respects. Patentee does not utilize an alkali metal compound soluble in the hydrocarbon phase but instead uses a separate treating agent phase containing an alkali metal hydroxide.

In U.S. Pat. No. 2,488,000, the presence of small percentages of water is recommended to reduce the solubility of the alcoholic solution in the hydrocarbon. The second stage of one embodiment of the present invention, on the other hand, employs a water saturated oxygen-containing gas stream, which water does not reduce the solubility of the alkali metal compound in the hydrocarbon.

U.S. Pat. No. 2,535,833 teaches the use of an alkali metal hydroxide in a monohydric alcohol in a sweetening process. In contradistinction to the second stage of one embodiment of the process of the present invention patentee uses water between the range of 5 and 20 wt.% when higher molecular weight alcohols are employed in order to prevent solution of large amounts of alcohol into the hydrocarbon liquid. In the process of the present invention the alkali metal compound is hydrocarbon soluble and not recovered.

U.S. Pat. No. 3,371,031 employs an alkali alcohol solution and the alkali alcohol solution is not soluble in the hydrocarbon phase and, therefore, constitutes an additional phase not present in the second stage of one embodiment of the present invention.

Further, the process of the present invention does not involve the prewashing steps as disclosed in U.S. Pat. No. 3,260,655. U.S. Pat. No. 3,260,655 also does not disclose the use of hydrated oxygen-containing gas wherein the gas is hydrated up to the saturation point of the gas at the particular temperature. None of the above-mentioned processes utilize the process of the present invention wherein a hydrocarbon soluble alkali metal compound is used in conjunction with a metal chelate catalyst disposed on an adsorptive support and hydrated oxygen-containing gas in the absence of a separate water phase.

The method of the present invention may be effected in accordance with operating conditions taught in the prior art. The process of the present invention is usually effected at temperatures of up to about 105° C. Pressures of up to about 100 psi or more are operable, although atmospheric or substantially atmospheric pressures are entirely suitable. Contact times equivalent to a liquid hourly space velocity of from about 0.5 to about 10 or more are effective to achieve a desired reduction in the mercaptan content of a sour petroleum distillate, an optimum contact time being dependent on the size of the treating zone, the quantity of catalyst contained therein, and the character of the distillate being treated.

As previously stated the second stage may be operated at superatmospheric pressures thereby permitting water saturated oxygen-containing gas, typically air, to be dissolved in the hydrocarbon phase prior to passage to the second stage reaction zone. Another method of operating the second stage reaction zone is in the trickle bed fashion with a gas continuous phase. The gas phase may be recycled to control the level of oxygen in the system.

The color of a hydrocarbon stock does not usually affect the use of a hydrocarbon stock as a fuel but with all things being equal, a fuel having a lighter color is preferred on an esthetic basis. It has been observed that color degradation during the sweetening process occurs at the most difficultly oxidized mercaptans are oxidized. This is believed to be due to the oxidation of phenols which are more readily oxidized than the oxidation-resistant residual mercaptans. By utilizing the present invention, the oxidation potential of the oxidation-resistant or difficultly oxidized mercaptans is lowered to less than that of the color forming phenols.

The following Example is presented in illustration of certain preferred embodiments of this invention and is not intended as an undue limitation on the generally broad scope of the invention as set out in the appended claims.

EXAMPLE

The kerosene used in this Example contained 950 ppm mercaptan sulfur, and possessed a boiling range from about 385° to about 532° F. The kerosene contained about 33 ppm of the difficultly oxidizable mercaptans, which is considered a very high amount. This kerosene was passed through a prior art sweetening process comprising a reaction zone containing 100 cc of conventional phthalocyanine catalyst supported on activated charcoal which catalyst was wetted by the periodic addition of dilute caustic solution (approximately 8 wt.%).

The activated charcoal supported cobalt phthalocyanine monosulfonate catalyst was prepared in accordance with conventional practice by absorbing the cobalt phthalocyanine monosulfonate on the activated charcoal support from a methanolic dispersion thereof. Thus, 150 mg of cobalt phthalocyanine monosulfonate was admixed with 50 ml of methanol and stirred for about 5 minutes. The resulting dispersion was then further diluted to 300 ml with methanol with an additional 5 minutes of stirring. About 100 cc of the activated charcoal particles, having an apparent bulk density of about 0.25 gm/cc and a particle size in the 10×30 mesh range, was immersed in the methanol dispersion, and the dispersion was stirred in contact with the particles for about 5 minutes and then maintained in contact with the particles for 1 hour under quiescent conditions. The methanolic dispersion was thereafter evaporated to dryness over a steam bath in contact with the charcoal particles, and the resulting impregnated particles were subsequently oven dried at 100° C. for 1 hour.

The reaction zone was operated at 100 psig and 75° F. The feed rate was 100 cc per hour. The air feed rate was 0.1 cubic feet per hour. The product contained a residual mercaptan level of 68 ppm. Doubling the contact time with the catalyst reduced the mercaptan content to 33 ppm. It is apparent that the prior art sweetening process is not effective in reducing the difficultly oxidizable mercaptan content to an adequate degree.

Another portion of kerosene feed was treated as hereinafter described. The first reaction zone contained 100 cc of the cobalt phthalocyanine catalyst described above, also similarly wetted by caustic. The air was passed to the zone at an excess of the amount required ($4RSH+O_2 \rightarrow 2RSSR+2H_2O$). The liquid hourly space velocity was 8. The product effluent from the stage 1 reaction zone contained 370 ppm mercaptan. This effluent after filtration to remove any suspended water was then passed to a second reaction zone containing 100 cc of cobalt phthalocyanine catalyst similar to the above-described catalyst.

When the effluent from the first stage was passed to the second stage over the dry catalyst bed with anhydrous air and with no sodium isopropoxide or water present, the mercaptan content was insignificantly reduced from 370 ppm to 336 ppm.

During the oxidation of mercaptans, water is produced according to the following equation:

$$4RS\text{-}H + O_2 \rightarrow 2R\text{-}S\text{-}S\text{-}R + H_2O$$

When the second stage operation is continued with the addition of sodium isopropoxide and anhydrous air but with no water addition, the rate of mercaptan oxidation gradually increases as the water which is formed during oxidation slowly begins to wet the catalyst surface. Thus, it is clear from the data presented in Table 1 that at least some measurable amount of water is essential to catalyze the oxidation of difficultly oxidizable mercaptans.

TABLE 1

| Volume of Feed/Volume of Catalyst | 0 | 2 | 8 | 14 | 22 |
|---|---|---|---|---|---|
| Product Mercaptan Content, PPM | 370 | 34 | 27 | 17 | 7 |

When the second stage is operated in a manner without the presence of water at the beginning of a run, the initial product contains a high concentration of mercaptan and is therefore commercially unacceptable. However, in accordance with the present invention, the effect of water by the introduction of hydrated air promotes the immediate and rapid oxidation of mercaptans which precludes the generation of off-spec or high mercaptan product which has a reduced value.

This effect was even made more evident when the amount of sodium isopropoxide to mercaptan was reduced to a 0.62 ratio thus reducing the amount of gradual water formation as shown in Table 2.

TABLE 2

| Volume of Feed/ Volume Catalyst | 0 | 2 | 6 | 10 | 20 | 30 | 38 |
|---|---|---|---|---|---|---|---|
| Product Mercaptan Content, PPM | 370 | 327 | 178 | 151 | 101 | 73 | 46 |

Another batch of feed was charged to the hereinabove described first stage at a liquid hourly space velocity (LHSV) of 1, compared to a LHSV of 8 as used in the previous run, to remove essentially all of the easily oxidized mercaptans. The effluent from the first stage contained 68 ppm or about 7% of the original 950 ppm. In order to demonstrate the oxidation-resistant characteristics of the residual mercaptans, the effluent from the first stage containing 68 ppm mercaptan was passed through the first stage again at a LHSV of 1 and the mercaptan level was reduced to 33 ppm or a 52% reduction in the mercaptan value compared to a 93% decrease for the first pass through the first stage. A third pass reduced the mercaptan level to 17 ppm or a 49% reduction. It is evident that the refractory nature of residual mercaptans is increasing.

In contrast to these results, a 5 molar ratio of sodium isopropoxide to mercaptan was added to the effluent from the first stage treatment containing 68 ppm mercaptan and the resulting admixture was passed through the second stage catalyst bed with a stoichiometric excess of air which was saturated with water. The results from this run are presented in Table 3.

TABLE 3

| Volume of Feed/Volume of Catalyst | 0 | 1 | 20 | 50 |
|---|---|---|---|---|
| Effluent Mercaptan Content, PPM | 68 | 0 | 0 | 1 |

This run was performed in accordance with the present invention and produced a doctor sweet product from the second stage as defined by a mercaptan level of less than about 10 ppm and the color of the product was considered good and was the same as that of the feed to the second stage.

The foregoing description and example clearly illustrate the improvements encompassed by the present invention and the benefits to be afforded with the use thereof.

I claim as my invention:

1. A process for oxidizing difficultly oxidizable mercaptans contained in a hydrocarbon fraction which comprises:
   (a) adding a hydrocarbon soluble alkali metal compound, capable of forming the alkali metal mercaptides of the difficultly oxidized mercaptans, to said hydrocarbon fraction; and
   (b) contacting the resulting hydrocarbon fraction containing said hydrocarbon soluble alkali metal compound with a metal chelate catalyst disposed on an adsorptive support in the presence of a hydrated oxygen-containing gas wherein the gas is hydrated up to the saturation point of the gas and in the absence of a separate water phase.

2. The process of claim 1 wherein said hydrocarbon soluble alkali metal compound is an alkali metal alkoxide or an alkali metal alkyl amide.

3. The process of claim 2 wherein said alkali metal alkoxide is a sodium or potassium alkoxide derived from a $C_3$ to $C_8$ monohydric alcohol.

4. The process of claim 1 wherein said alkali metal containing compound is present in an amount such that the molar ratio of said compound to the difficultly oxidizable mercaptan level ranges from about 0.5 to about 5.

5. The process of claim 1 wherein said metal chelate catalyst is a metal phthalocyanine.

6. The process of claim 5 wherein said metal phthalocyanine is cobalt phthalocyanine.

7. The process of claim 5 wherein said phthalocyanine catalyst is disposed on an adsorptive support comprising activated charcoal.

8. The process of claim 1 wherein said hydrated oxygen-containing gas is dissolved in said hydrocarbon fraction at a superatmospheric pressure.

9. A combination process for oxidizing difficultly oxidizable mercaptans contained in a hydrocarbon fraction in admixture with non-difficultly oxidizable mercaptans which comprises the conversion of the non-difficultly oxidized mercaptans, the oxidation of the difficultly oxidizable mercaptans by the addition of a hydrocarbon soluble alkali metal compound, capable of forming the alkali metal mercaptides of the difficultly oxidized mercaptans and the contact of the hydrocarbon fraction containing said alkali metal mercaptides with a metal chelate catalyst disposed on an adsorptive support in the presence of a hydrated oxygen-containing gas wherein the gas is hydrated up to the sturation point of the gas and in the absence of a separate water phase.

10. The process of claim 9 wherein said hydrocarbon soluble alkali metal compound is an alkali metal alkoxide or an alkali metal alkyl amide.

11. The process of claim 10 wherein said alkali metal alkoxide is a sodium or potassium alkoxide derived from a $C_3$ to $C_8$ monohydric alcohol.

12. The process of claim 9 wherein said alkali metal containing compound is present in an amount such that the molar ratio of said compound to the difficultly oxidizable mercaptan level ranges from about 0.5 to 5.

13. The process of claim 9 wherein said metal chelate catalyst is a metal phthalocyanine.

14. The process of claim 13 wherein said metal phthalocyanine is cobalt phthalocyanine.

15. The process of claim 13 wherein said phthalocyanine catalyst is disposed on an adsorptive support comprising activated charcoal.

16. The process of claim 9 wherein said hydrated oxygen-containing gas is dissolved in said hydrocarbon fraction at a superatmospheric pressure.

17. The process of claim 9 wherein said conversion of non-difficultly oxidized mercaptans is conducted in the presence of a metal chelate catalyst disposed on an adsorptive support.

18. The process of claim 17 wherein said conversion of non-difficultly oxidized mercaptans is conducted in the presence of an alkaline reagent.

* * * * *